United States Patent [19]

Abdalla

[11] 4,387,729

[45] Jun. 14, 1983

[54] EGYPTIAN HAIR DRYER

[76] Inventor: Lawrence H. Abdalla, P.O. Box 3078, Center Line, Mich. 48015

[21] Appl. No.: 12,572

[22] Filed: Feb. 15, 1979

[51] Int. Cl.[3] ..... A45D 2/12

[52] U.S. Cl. ..... 132/33 R

[58] Field of Search ..... 132/33 R, 32 R, 37 R, 132/9; 34/97; 219/225, 222, 241, 273, 533

[56] References Cited

U.S. PATENT DOCUMENTS

| | | | |
|---|---|---|---|
| 2,156,687 | 5/1939 | Grabner | 132/33 R |
| 2,590,669 | 3/1952 | Zachary | 132/33 R |
| 3,802,442 | 4/1974 | Serdar | 132/9 |
| 3,890,984 | 6/1975 | Lesetar | 132/9 |
| 3,981,314 | 9/1976 | Barradas | 132/9 |
| 4,005,720 | 2/1977 | Machata | 132/40 |

*Primary Examiner*—G. E. McNeill

*Attorney, Agent, or Firm*—Cullen, Sloman, Cantor, Grauer, Scott & Rutherford

[57] ABSTRACT

This invention pertains to a new concept in hair drying. To achieve this concept requires the use of modified rollers and a drying unit which is also modified to represent an improvement over conventional drying methods. Plastic tubing from the drying unit is inserted and enclosed inside perforated rollers which have been used to roll wet strands of hair. When the unit is in operation, hot air can only escape through the perforation of the roller which is covered with wet hair. Since the air stream is directed away from the scalp, there is less chance of burning the scalp. The heat also penetrates a larger volume of hair which decreases drying time.

4 Claims, 6 Drawing Figures

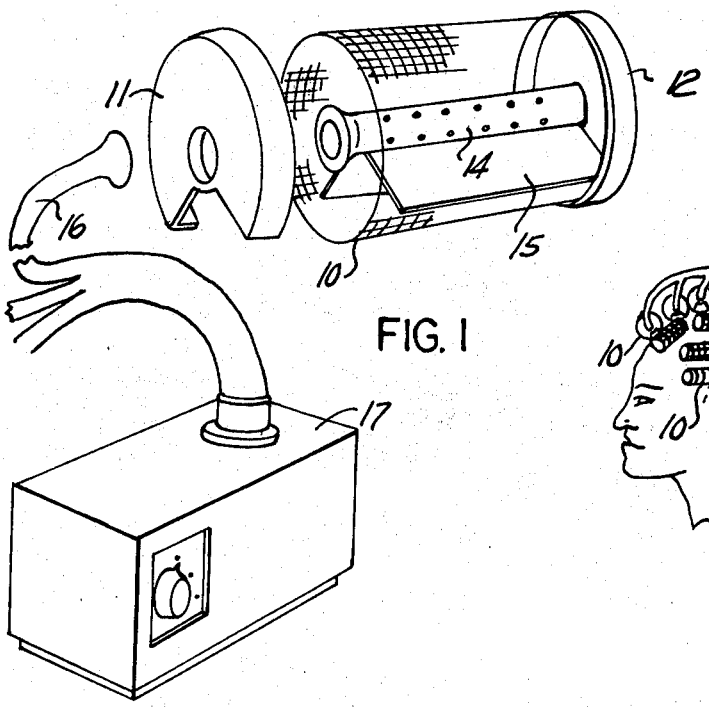
FIG. 1
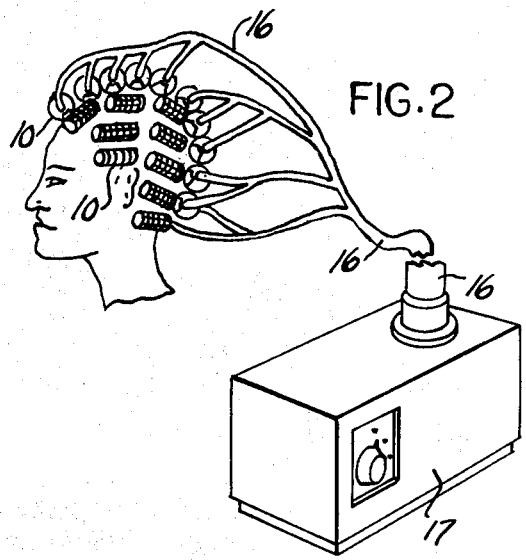
FIG. 2
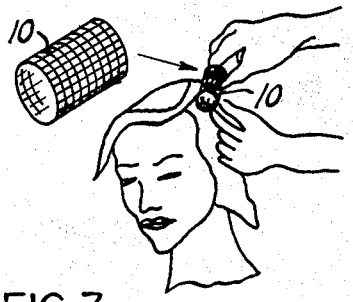
FIG. 3
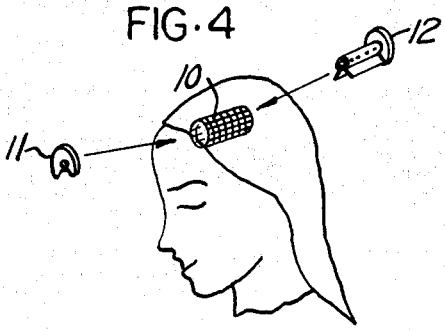
FIG. 4
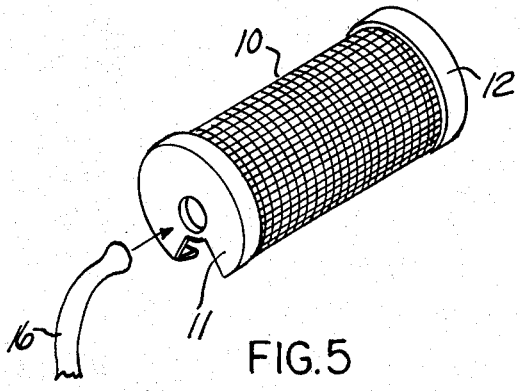
FIG. 5
FIG. 6
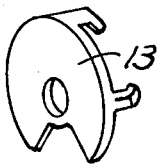

EGYPTIAN HAIR DRYER

REFERENCES

Cross-references cited in the file of this application are as follows:

| U.S. Pat. No. | NAME | DATE |
|---|---|---|
| 3,973,100 | FLANAGAN | AUG. 3, 1976 |
| 3,934,114 | GODEL ET AL. | JAN. 20, 1976 |
| 3,911,935 | WALLIN | OCT. 14, 1975 |
| 3,814,898 | LEVINE | JUNE 4, 1974 |
| 3,760,148 | BOUDOURIS ET AL. | SEPT. 18, 1973 |

SUMMARY

This invention relates to hair drying and has for its general object to provide a construction which will allow long hair to dry rapidly while being constrained to a circular shape. Another object of the invention is to provide a construction which will prevent harm to its user. Another object is to provide a product which is simple to design and easy to manufacture.

DESCRIPTION

These and other objects may be readily discovered upon reading this specification in which:

FIG. 1 is a perspective view showing the drying unit, tube or hose extensions and one of the twenty or more possible roller attachments.

FIG. 2 is a completely assembled view of the invention which is ready for operation.

FIG. 3 is a fragmentary perspective view, and illustrates how the hair is prepared with the roller portion of the dryer.

FIG. 4 is a fragmentary perspective view, and depicts the internal components assembled inside the roller.

FIG. 5 is a fragmentary perspective view and shows tubing from the drying unit being assembled to the modified roller.

FIG. 6 is a modification of the end caps shown in FIG. 1.

Referring to the drawings in detail, the roller (10) is formed having a cylinder shape with a perforated structure resembling mesh wire. After a wet strand of hair has been wrapped around the roller and secured to the scalp with a roller pin, two disc-like caps (11,12) are fitted over openings on each end of the roller. One of the caps (12) has a hollow tube (14) extending from the center of its face. The tube (14) is provided with holes which will allow hot air to pass through. The tube also has rectangular panels (15) which are designed to direct hot air away from the scalp. The panels also serve as guides which allows easy assembly in aligning the tube (14) with the opposite cap (11). The cap with the hollow tube (12) is inserted inside the roller (10) and snaps together when the cap on the opposite end (11) joins with the roller and the free end of the tube. The free end of the tube is formed as shown to insure an air tight fit when mated with the cap (11). To prevent interference with the roller pin, a triangular section has been cut out of the caps (11,12).

The cap (11) which mates with the tube (14) also mates with tubing from the drying unit (17). A hole is provided in the center of this cap (11) to allow these components (14,16) to snap together. This implies that the free end of these tubes (16) are also formed to allow a snap together assembly.

All the components mentioned in these drawings with the exception of the roller (10) should be made of a plastic material. The reason being that the rollers must be dismantled and removed from the hair after dryness has been achieved. Many drying units (17) are available and can be converted to this concept by attaching a tree of tubing (16) to the dryers outlet. FIG. 2 depicts the Egyptian hair dryer in operation. The modified form of the invention, shown in FIG. 6, is caps (13) with fasteners to insure a tighter fit.

I claim:

1. A hair dryer and curler comprising an elongated perforated tube upon which a lock of hair may be wound;

first and second impervious caps, each having an annular flange snugly anchored over the ends of said tube;

said first cap having a central aperture adapted to snugly receive a pressurized heated air supply conduit;

an elongated air delivery tube at one end centrally secured to said second cap and closed thereby, coaxial to and spaced radially inward of said perforated tube, having an open end connected to said first cap in registry with its aperture, for receiving pressurized heated air;

said air delivery tube having a plurality of apertures therethrough arranged in a pattern along its length over the top of said perforated tube, portending an arc in the range of 180 degrees to 270 degrees, whereby the heated air flows outwardly of the air delivery tube and said perforated tube away from the users scalp.

2. In the hair curler of claim 1, said arc being 270 degrees, approximately.

3. In the hair curler of claim 1, a pair of elongated diverging rectangular panels at their inner longitudinal edges extending along and connected to said air delivery tube and at their ends engaging said caps respectively;

said panels encompassing an area of said air delivery tube outside its air delivery apertures, and extending radially outward to said perforated tube.

4. In the curler of claim 3, each of said caps having a depending cutaway notch of sector shape corresponding to the end edge of said panels, providing an elongated clearance opening upon the underside of said curler for facilitating attachment of the curled hair strands at the users scalp.

* * * * *